US005149382A

United States Patent [19]

Gray

[11] Patent Number: 5,149,382

[45] Date of Patent: Sep. 22, 1992

[54] METHOD OF PRETREATING METAL BY MEANS OF COMPOSITION CONTAINING S-TRIAZINE COMPOUND

[75] Inventor: Ralph C. Gray, Allison Park, Pa.

[73] Assignee: PPG Industries, Inc., Pittsburgh, Pa.

[21] Appl. No.: 749,237

[22] Filed: Aug. 23, 1991

Related U.S. Application Data

[62] Division of Ser. No. 426,355, Oct. 25, 1989, abandoned.

[51] Int. Cl.[5] ..... C23C 22/82

[52] U.S. Cl. ..... 148/257; 148/274; 106/14.15; 106/14.16

[58] Field of Search ..... 148/257, 274; 106/14.15, 14.16

[56] References Cited

U.S. PATENT DOCUMENTS

| | | | |
|---|---|---|---|
| 4,376,000 | 3/1983 | Lindert | 148/6.15 R |
| 4,402,907 | 9/1983 | Clark | 106/14.15 |
| 4,433,015 | 2/1984 | Lindert | 427/388.4 |
| 4,457,790 | 7/1984 | Lindert et al. | 148/6.15 R |
| 4,517,028 | 5/1985 | Lindert | 148/6.14 R |
| 4,877,552 | 10/1989 | Haring | 106/14.16 |

*Primary Examiner*—Sam Silverberg

*Attorney, Agent, or Firm*—Daniel J. Long; Godfried R. Akorli; William J. Uhl

[57] ABSTRACT

Disclosed herein is an aqueous composition containing an S-triazine compound having at least one hydroxyl group composition adapted for use in pretreating a ferrous or non-ferrous metal surface.

5 Claims, No Drawings

METHOD OF PRETREATING METAL BY MEANS OF COMPOSITION CONTAINING S-TRIAZINE COMPOUND

This is a division of application Ser. No. 07/426,355, filed Oct. 25, 1989, now abandoned.

BACKGROUND OF THE INVENTION

1. Field of the Invention

The present invention relates to a pretreatment composition which is free of chromic acid; said composition is particularly useful as a final rinse in a metal pretreatment process.

2. Brief Description of the Prior Art

In the metal pretreatment process, it is known to employ a phosphating conversion coating which is usually followed by a final rinsing or sealing step. The rinsing composition usually comprises chromic acid. While effective in the rinsing step, chromic acid is, nonetheless, undesirable because of its toxicity and the attendant problems of disposal.

Hence, considerable work has been done in finding a replacement for chromic acid in the final rinsing step. The present invention provides a pretreatment composition which is essentially free of chromic acid.

SUMMARY OF THE INVENTION

In accordance with the foregoing, the present invention encompasses an aqueous composition comprising an S-triazine having at least one hydroxyl group on a carbon atom of the triazine ring (hereinafter "S-triazine compound") adapted for use for pretreating a ferrous or non-ferrous metal surface. The aqueous composition of the S-triazine compound contains at least about 0.1 percent by weight or higher of the S-triazine compound based on the total weight of the composition, at a pH of about 3.4 to 6 and a temperature range of about 30° C. to 80° C.

The invention further encompasses a process of pretreating a metal surface comprising applying an effective aqueous composition of the S-triazine compound to the metal surface to produce a corrosion resistant surface that can adhere to a subsequently applied coating. Preferably, the aqueous composition of the S-triazine compound is employed as a final rinse over a metal surface comprising a conversion coating such as a phosphate conversion coating.

DETAILED DESCRIPTION OF THE INVENTION

The S-triazine compound or a modification thereof which, useful herein, is one that enolizes in a manner that renders the aqueous composition containing the same acidic. While not desiring to be bound to any particular theory, it is believed that the enolized form of the S-triazine compound is reactable with the metal surface. The enol form of the preferred S-triazine compound is commonly referred to as cyanuric acid. In accordance with this invention, the S-triazine compound or a modification thereof useful herein is characterized as having at least one hydroxyl group on a carbon atom of the triazine ring.

The useful S-triazine compound must be compatible with an aqueous medium, i.e., it is mixable to produce an effective aqueous composition that can be applied to a substrate to produce a corrosion resistant surface that can adhere to a subsequently applied coating. Typically, it must have solubility of at least about 0.01 gram per 100 grams of water at 25° C. The aqueous composition of this invention can be prepared by mixing the S-triazine compound with an aqueous medium, preferably at a temperature of about 30° C. to 80° C. and more preferably about 40° C. to 80° C. By an aqueous medium is meant water or water in combination with an adjuvant that can enhance the solubility of the S-triazine compound. The aqueous composition may also contain an additive such as a pH buffer, phosphate, borate, potassium salt or the like or a mixture thereof.

Accordingly, the aqueous pretreating composition of this invention can have a pH of about 3.4 to 6 and preferably about 4.0 to 5.0. The composition can contain about 0.01 to 0.2 percent by weight and preferably about 0.05 to 0.15 percent by weight of the S-triazine compound based on the total weight of the composition. While higher amounts of the S-triazine compound can be employed in the aqueous composition, it does not appear that there is an improvement in performance of such a composition. However, under certain circumstances, the higher concentration in the form of a concentrate may be desirable, for reasons such as ease of handling.

The aqueous composition of the S-triazine compound is applied under conditions that produce a corrosion-resistant barrier which is receptive to a subsequent coating process such as a conventional coating or electrocoating. The temperature of the aqueous composition at which a substrate is treated therewith is typically from about 30° C. to 80° C. and preferably about 40° C. to 60° C. The pH of the treating composition during application is typically about 3.5 to 6 and preferably about 4 to 5.0.

In the process of this invention, the aqueous composition of the S-triazine compound is employed in treating a ferrous or non-ferrous metal such as cold rolled steel, galvanized steel or the like. Preferably, the aqueous composition is applied to a metal surface comprising a conversion coating such as a phosphated conversion coating; a zinc phosphate conversion coating is preferred herein. The aqueous composition containing the S-triazine compound is applied to the metal surface by spraying, immersion or any other convenient means. After the aqueous composition has been applied, the metal is usually rinsed with deionized water and then coated with a surface coating, usually after it has been dried.

In a typical pretreatment process, the metal to be treated is cleaned by a physical or chemical means and water rinsed in order to remove surface contamination such as grease or dirt. The metal surface is then brought into contact with a conversion coating composition, rinsed with water and then rinsed with the composition of this invention. After the application of the aqueous solution of the S-triazine compound with rinsing and drying, the ferrous or non-ferrous metal can be coated by any convenient means. It has been found that the pretreatment process of the metal with the aqueous composition of the S-triazine compound imparts to the coated substrate improved adhesion and corrosion resistance properties.

The invention is further illustrated by the following non-limiting examples.

EXAMPLE 1

Hot dipped galvanized steel panels were phosphated with CHEMFOS 710 zinc nickel manganese phosphating solution (from Chemfil Corporation) at an average coating weight of 270 mg/ft$^2$. The panels were then rinsed with water to remove residual phosphating chemicals and then immersed for 30 seconds in an aqueous solution of cyanuric acid at 120° F. Two concentrations of the cyanuric acid solutions were employed: 0.1 and 0.2 percent cyanuric acid in city water. The measured pH's were 4.0 and 3.4, respectively. The panels were dried with a compressed air jet and primed the same day with ED3150W electrodeposition primer (from PPG Industries, Inc., herein "PPG") at about 240 volts giving about 1.2 to 1.6 mils dry film thickness. The panels were subsequently top coated with HUBC 90270 white basecoat (from PPG) at about 0.9 mils and then with URC 1000 clearcoat (from PPG) at about 1.9 mils. The panels were then prepared for testing by scribing and abrading with steel shot according to the "CHRYSLER" chipping scab test procedure, as follows.

1) 4"×12" test panels were coated as described above.
2) The top half of the panel was scribed with a 12 cm (4.7") "X" scribe. A strip of pull tape was firmly applied to one side of the "X" and removed in a rapid vertical motion. Repeat of this procedure was conducted with the other side of the "X."
3) The air pressure of the gravelometer (from the Q-Panel Company) was adjusted to 205 kPa (30 psi).
4) The air valve of the gravelometer was shut off and 200 ml (32 oz.) of steel shot was collected.
5) A test panel was placed in the panel holder with the coated side facing the gravel projecting mechanism of the gravelometer. The lid of the test chamber was then closed.
6) The air valve was opened to let the pressure stabilize. Two hundred milliliters (200 ml) (32 oz.) of shot was poured into the hopper. The air was turned off when all of the shot had been spent.
7) The panel was placed in 5 percent salt solution (pH of about 6.6 to 7.1) for a minimum of 15 minutes.
8) The panel was removed and allowed to recover at lab conditions for 1 hour and 15 minutes and then placed in humidity cabinet for 22.5 hours.

An "accelerated" test was conducted as follows:

a) The humidity cabinet was set at 85 percent relative humidity and 60° C. (140° F.).
b) A cycle program as outlined in steps 7 to 8 was run over a period of four days.
c) Thereafter (on the fifth day), the panel was removed from the humidity cabinet and within 30 minutes, steps 3 to 8, as set forth above, were followed.
d) At the conclusion of a five-week cycle of steps a–c (after step 6), the panels were washed with sponge and water (a mild detergent could be used). Excess water was removed and the panel(s) were allowed to recover for 30 minutes.
e) The target areas was covered with pull tape and removed as outlined in step 2.
f) The percent paint loss in the target area was estimated.

CONTROL: Control panels were also prepared with CHEMSEAL 20 chrome rinse (from Chemfil Corporation) and with a deionized water rinse for comparison purposes. Triplicate panels were prepared for each system and subjected to the same CHRYSLER chipping scale test as described above. The total test period was 10 weeks. The panels were evaluated according to the amount of paint removed by taping with #898 3M SCOTCH tape after the test period. The results of the tests are reported in Table I hereinbelow.

TABLE I

| RESULTS | PAINT ADHESION LOSS |
|---|---|
| .1% aqueous composition of cyanuric acid rinse | 4% |
| .2% aqueous composition cyanuric acid rinse | 4% |
| CHEMSEAL 20 chrome rinse | 10% |
| Deionized water rinse | 24% |

EXAMPLE 2

Cold rolled steel (CRS) and hot dipped galvanized (HDG) panels were phosphated with CHEMFOS 86 zinc nickel phosphate (from Chemfil Corporation) at about 230 mg/ft$^2$. After rinsing with water, the panels were immersed for 30 seconds in a 0.1 percent solution of cyanuric acid in water at 120° F., pH at 4.1.

Controls for comparison were made with CHEMSEAL 20 chrome rinse and with deionized water. The series were rinsed with deionized water, dried with a compressed air jet, and primed with UNI-PRIME electrocoat (from PPG) at 240 volts for 1.2 mils thickness on cold rolled steel. The panels were top coated with HUBC 90270 white basecoat at 1.0 mils and URC 1000 clearcoat at 1.6 mils. Triplicate panels were prepared and tested according to the CHRYSLER chipping scab test described in Example 1. The results of the test are reported in Table II hereinbelow.

TABLE II

| RESULTS | PAINT ADHESION LOSS ON: HDG[1] | CRS[2] |
|---|---|---|
| .1% aqueous composition of cyanuric acid rinse | 6% | 17% |
| CHEMSEAL 20 Rinse | .5% | 24% |
| Deionized Water Rinse | 12% | 24% |

[1]Hot dipped galvanized steel.
[2]Cold rolled steel.

EXAMPLE 3

Heavy gauge hot rolled steel panels were pretreated with CHEMFOS 86 zinc nickel phosphate coating at about 240 mg/ft$^2$, rinsed with water, and immersed for 30 seconds in 0.1 percent aqueous composition of cyanuric acid at 120° F. The panels were then rinsed again with water, dried with compressed air, and then painted with a single coat of ED 4201 black electrocoat primer (from PPG) at about 0.8 mils dry thickness.

Control panels were prepared with CHEMSEAL 20 chrome and with deionized water rinses. Triplicate panels were prepared for each system and tested in essentially the same manner as described in the CHRYSLER scab test cabinet for eight weeks. The results of the test are reported in Table III hereinbelow.

TABLE III

| RESULTS | SCRIBE CREEPAGE | FACE CORROSION (ASTM D610-85)* |
|---|---|---|
| .1% Cyanuric Acid Rinse | ¼ inch | 7 |
| CHEMSEAL 20 Rinse | 5/16 inch | 6 |
| Deionized Water Rinse | ½+ inch | 7 |

*The numerical rating for this aspect of the test is based on a scale of 0 to 10, with 10 indicating no failure and 0 indicating the total failure from rusting accompanied blistering which is not initially evidenced by visible rust.

While the illustrative embodiments of the invention have been described hereinabove, it will be understood that various modifications will be apparent to and can be made by those skilled in the art without departing from the scope or spirit of the invention. Accordingly, it is intended that the claims directed to the invention be construed as encompassing all aspects of the invention which would be treated as equivalents by those skilled in the art to which the invention pertains.

Therefore, what is claimed is:

1. A process of pretreating a metal surface which comprises applying to said surface an aqueous composition having a pH of about 3.4 to 6.0 at a temperature of about 30° C. to 80° C., said composition comprising at least 0.01 percent by weight based on the total weight of the composition of a cyanuric acid.

2. The process of claim 1 wherein the pH is about 4 to 5.0.

3. The process of claim 1 wherein the cyanuric acid is present in an amount of about 0.05 to 0.15 percent by weight based on the total weight of the composition.

4. The process of claim 1 wherein the metal surface comprises a phosphate conversion coating.

5. The process of claim 4 wherein the conversion coated metal surface comprises a zinc phosphate coating.

* * * * *